United States Patent [19]

Ferstenfeld

[11] Patent Number: 4,642,817

[45] Date of Patent: Feb. 17, 1987

[54] ADJUSTABLE SWEATBAND FOR HAT

[75] Inventor: Bernard Ferstenfeld, Hampstead, Canada

[73] Assignee: Fersten Headwear, Inc., Laurent, Canada

[21] Appl. No.: 741,794

[22] Filed: Jun. 6, 1985

[51] Int. Cl.[4] ..... A42B 1/22

[52] U.S. Cl. ..... 2/183; 2/197; 2/DIG. 11

[58] Field of Search ..... 2/181, 181.1, 181.2, 2/181.4, 182.1, 182.2, 183, 418, 420, DIG. 11, DIG. 6, 197, 185 B, 184

[56] References Cited

U.S. PATENT DOCUMENTS

| | | | |
|---|---|---|---|
| 341,616 | 5/1886 | Upham | 2/183 |
| 1,725,425 | 8/1929 | Steingold | 2/183 |
| 1,837,695 | 12/1931 | Werner | 2/183 X |
| 1,894,213 | 1/1933 | Ostolaza | 2/182.1 |
| 4,011,600 | 3/1977 | Malk | 2/183 |
| 4,481,681 | 11/1984 | Hankin | 2/183 X |

*Primary Examiner*—Werner H. Schroeder
*Assistant Examiner*—Andrew M. Falik
*Attorney, Agent, or Firm*—Swabey, Mitchell, Houle, Marcoux & Sher

[57] ABSTRACT

A hat is provided having a sweatband which is discontinuous over a portion of the crown and has overlapping sweatband extensions with fastening means for adjusting the size of the hat. A stiff plastic strip is provided in this area on the crown to keep it from gathering.

4 Claims, 4 Drawing Figures

ADJUSTABLE SWEATBAND FOR HAT

BACKGROUND OF THE INVENTION

1. Field of the Invention

The present invention relates to a hat, and more particularly to a size adjustable sweatband for the purpose of permitting different size adjustments.

2. Description of the Prior Art

Heretofore, various types of adjustable sweatbands have been provided in hats for the purpose of permitting a one size hat to be worn comfortably by persons having different head sizes and thus avoiding the cost of making a different size hat for each standard size. Examples of such hats are described in U.S. Pat. Nos. 1,748,375, Wittcoff, 1930; 1,894,213, Ostolaza, 1933; 4,011,600, Malk, 1977; and 4,481,681, Hankin, 1984.

When hats, having the above adjustable devices, are worn by persons having head sizes in the minimum part of a range practical to wear a given hat, the girth of the hat, which of course does not change, will be at variance with the adjusted size of the sweatband. This variance will normally cause the molded hat, when made of felt-like or straw-like material, to gather or crumple in the crown area subtended by the drawstring as in the Ostolaza patent or the detached portion of the sweatband as described in patents such as Hankin or Malk.

SUMMARY OF THE INVENTION

It is an aim of the present invention to provide a hat construction with an adjustable sweatband adapted to fit a variety of head sizes and to avoid some of the shortcomings of the present adjustable hats as illustrated in the prior art.

A construction in accordance with the present invention comprises a hat of soft to semi-rigid material having a crown and a sweatband attached at least along a lower margin thereof to the crown for a major portion of its extent and thus leaving a portion of the crown free of the sweatband. The ends of the sweatband adjacent the portion of the crown free of the sweatband include extensions adapted to subtend the sweatband-free crown portion and overlap each other. The overlapping extensions of the sweatband include fastening means operable for adjusting the girth of the sweatband at any position falling within a given range of adjustment.

In a more specific embodiment, the sweatband-free portion of the crown includes a reinforcing strip in order that the sweatband-free portion be relatively rigid and thus resist gathering when the hat is being worn.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
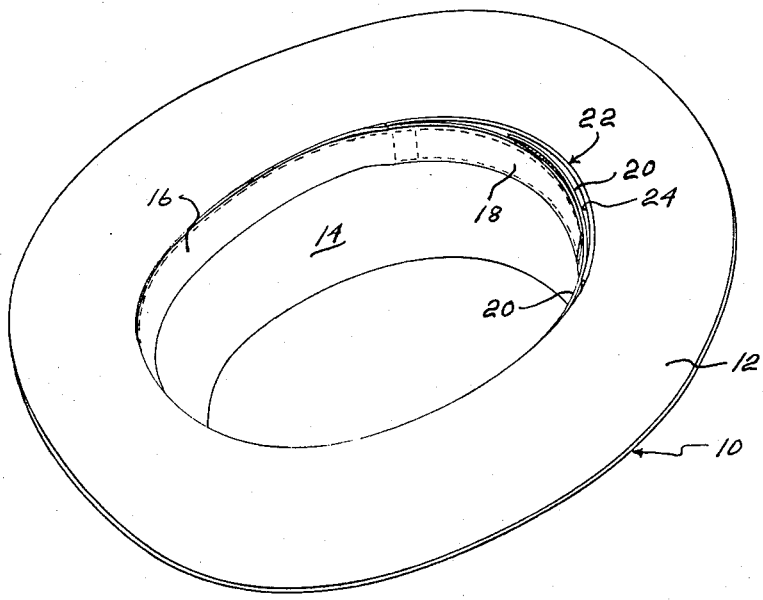
FIG. 1 is a perspective view as seen from the bottom of a typical hat incorporating the adjustable sweatband of the present invention.
Figure 2:
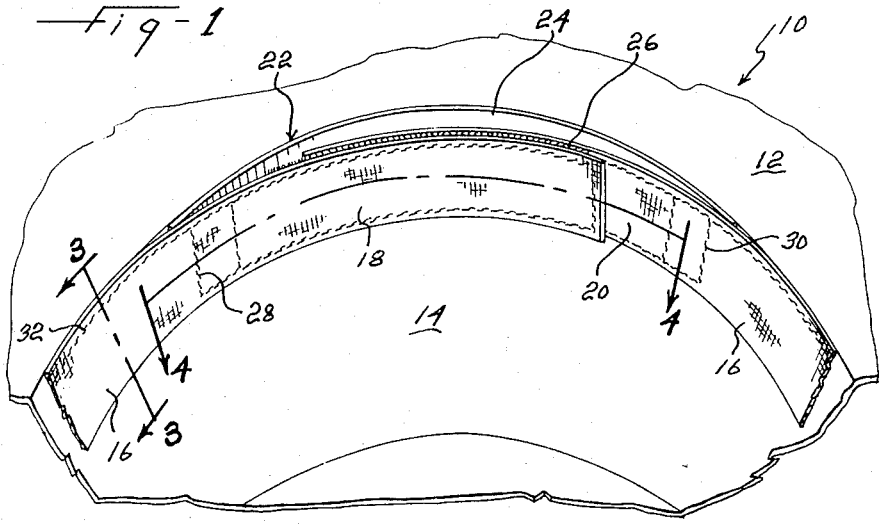
FIG. 2 is a fragmentary enlarged perspective view of a detail shown in FIG. 1.
Figure 3:
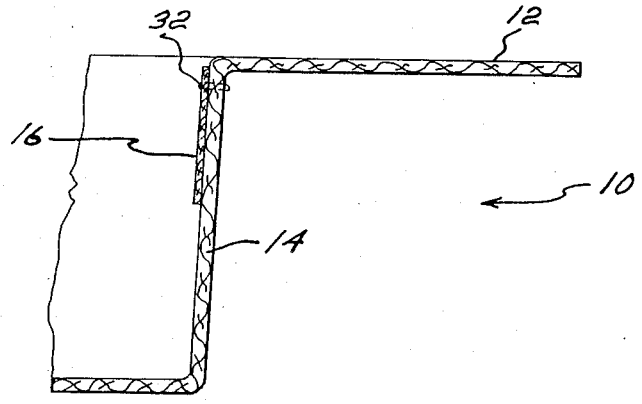
FIG. 3 is a vertical cross-section taken along line 3—3 of FIG. 2.
Figure 4:
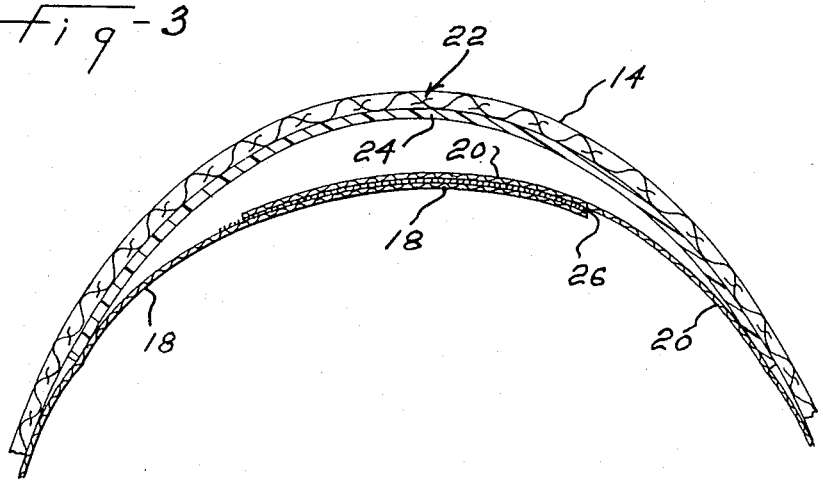
FIG. 4 is a horizontal cross-section taken along line 4—4 of FIG. 2.

Referring now to the drawings, the hat is identified by the numeral 10 and includes a crown 14 and a brim 12. A sweatband 16 of suitable flexible fabric material is secured along its lower margin by means of stitching 32 to the lower part or headsize of the crown 14. The sweatband 16 is stitched in this manner to the crown in such a way that a sweatband-free portion 22 is left near the rear of the hat when the sweatband is not attached or otherwise connected to the crown in the portion 22. In the sweatband-free portion 22, a strip 24 of relatively rigid plastic material may be glued or otherwise fixed to the crown and extends for the full length of the sweatband-free portion 22, as shown in FIGS. 2 and 4.

The sweatband 16 includes extensions 18 and 20 which overlap with each other and are provided with a fastening device such as VELCRO (trade mark). The sweatband 16 is sewn through the rigid strip 24 at 28 and 30 being the termination of the sweatband fixed to the crown in order to provide a pivot means for the extensions 18 and 20 respectively of the sweatband.

When it is required that the hat be worn, the extensions 18 and 20 are adjusted to the size of the head of the person proposing to wear the hat and are fixed in the adjusted position by the VELCRO 26. When the hat is being worn in such a way, as shown in FIG. 4, the rigid strip 24 will be functional to prevent that portion of the crown from gathering as would be the case if the strip did not exist. Thus, the appearance of the hat, even when being worn in the lower range of the permissible sizes for a particular hat, will leave a clean uncrumpled appearance.

The sweatband 16 can, of course, be provided with conventional moisture absorbing materials on the inner side between the crown and the band thereof. It is only in the area of the extensions 18 and 20 that such moisture absorbing material might be replaced by the VELCRO fastener fabric.

I claim:

1. In a hat of soft or semi-rigid material having an uninterrupted crown, a sweatband attached on the interior of the crown at least along the lower margin thereof to the crown for a major portion of the extent of the crown and being unattached to the crown for the remaining minor portion of the crown, thus leaving a portion of the crown free of the sweatband; the ends of the sweatband adjacent the minor portion of the crown including extensions adapted to subtend the minor portion of the crown and overlap each other at the interior of the crown, the overlapping extensions of the sweatband including fastening means operable for adjusting the girth of the sweatband at any position falling within a given range of adjustment, the minor portion of the crown including a rigid reinforcing strip fixed to the crown such that the minor portion of the crown is rigid and resists gathering when the hat is being worn.

2. In a hat as defined in claim 1, wherein stitching is provided widthwise of the sweatband in the areas adjacent the sweatband-free portion of the crown to allow drawing of the extensions.

3. In a hat as defined in claim 1, wherein the reinforcing strip is a relatively rigid thermoplastic material adhered to the crown.

4. In a hat as defined in claim 1, wherein the fastening means is VELCRO fabric on each extension thereof.

* * * * *